US005529525A

United States Patent [19]

Deal

[11] Patent Number: 5,529,525

[45] Date of Patent: Jun. 25, 1996

[54] WATER BOMB - MOUNTED WATER GUN

[76] Inventor: Jeffry T. Deal, 278 Goat Hill Rd., Lambertville, N.J. 08530

[21] Appl. No.: 318,138

[22] Filed: Oct. 5, 1994

Related U.S. Application Data

[63] Continuation-in-part of Ser. No. 272,091, Jul. 8, 1994.

[51] Int. Cl.[6] ..... A63H 33/30

[52] U.S. Cl. ..... 446/473; 446/186; 446/224; 446/475; 222/79; 222/212

[58] Field of Search ..... 446/180, 186, 446/267, 473, 475, 224; 222/78, 79, 183, 212; 251/4

[56] References Cited

U.S. PATENT DOCUMENTS

| | | | |
|---|---|---|---|
| 1,986,484 | 1/1935 | Schleuter | 251/4 |
| 2,844,351 | 7/1958 | Smith | 251/4 |
| 3,486,539 | 12/1969 | Jacuzzi . | |
| 3,848,808 | 11/1974 | Fetty et al. | 222/78 |
| 3,876,115 | 4/1975 | Venus, Jr. et al. | 222/212 |
| 4,121,737 | 10/1978 | Kain | 222/212 |
| 4,135,559 | 1/1979 | Barnby . | |
| 4,194,461 | 3/1980 | Kubiatowicz | 446/186 |
| 4,212,460 | 7/1980 | Kraft . | |
| 4,257,460 | 3/1981 | Paranay et al. . | |
| 4,458,830 | 7/1984 | Werding . | |
| 4,735,239 | 4/1988 | Salmon et al. . | |
| 4,854,480 | 8/1989 | Shindo . | |
| 4,890,838 | 1/1990 | Rudell et al. . | |
| 4,991,847 | 2/1991 | Rudell et al. . | |
| 5,064,095 | 11/1991 | Camerino | 222/212 |
| 5,174,477 | 12/1992 | Schafer | 222/78 |
| 5,238,149 | 8/1993 | Johnson et al. | 222/79 |
| 5,288,256 | 2/1994 | Lee et al. . | |
| 5,354,225 | 10/1994 | Hix | 446/473 |
| 5,366,108 | 11/1994 | Darling | 446/473 |

*Primary Examiner*—Robert A. Hafer
*Assistant Examiner*—Jeffrey D. Carlson
*Attorney, Agent, or Firm*—Kenneth P. Glynn

[57] ABSTRACT

The present invention is a toy water bomb— mounted water gun. By the attachment of the water bomb device to a toy gun the present invention provides new functionality of the toy gun by being able to simulate a water "explosion". The water bomb device has a main housing which includes a frontward and rearward portion rotatably connected to one another and a passageway through both the frontward and rearward portions for receiving a shut off valve. The shut off valve is located within the housing and connected to both the frontward and rearward portions and adapted so that when the frontward and rearward portions are rotated relative to one another, the shut off valve is moved from an open position to a closed position. A locking mechanism releasably connects the frontward and rearward portions, such that rotation of the frontward portion relative to the rearward portion will close the shut off valve and the locking mechanism may then hold the shut off valve in its closed position until subsequently released by a trigger. An expandable bladder is filled with liquid and expends liquid when the device is activated and the shut off valve is opened.

20 Claims, 6 Drawing Sheets

WATER BOMB - MOUNTED WATER GUN

REFERENCE TO RELATED APPLICATION

This application is a Continuation-In-Part of U.S. patent application Ser. No. 08/272,091, filed on Jul. 8, 1994 and entitled "Toy Water Bomb Device" by the inventor herein.

BACKGROUND OF THE INVENTION

1. Field of the Invention

The present invention relates to a water bomb mounted on a toy gun and, more particularly, such toy devices which release an explosive water burst, when triggered. It relies upon a releasable locking mechanism and a frontward portion and rearward portion of a main housing which cooperate so as to simultaneously shut off a valve and lock the frontward portion and rearward portion when rotated relative to one another by a user. The locking mechanism is released by a release trigger.

2. Information Disclosure Statement

Water guns and water toys have been popular with children for decades. The following patents are representative of toys and other devices which utilize bladders for containing and subsequently expelling water or involve water bomb type toys:

U.S. Pat. No. 5,288,256 to Lee et al. describes a thrown water propelling and dispensing toy. The thrown toy has a water tank with valves which are opened by centrifugal force. When thrown, the toy is designed to whirl so that the centrifugal force opens a valve and water is dispersed out the valves while the toy is in flight.

U.S. Pat. No. 4,991,847 to Rudell et al. describes a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,890,838 to Rudell et al. describes a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 4,458,830 to Werding describes an appliance for discharging a non-compressible liquid, creamy or pasty product under pressure. The container of rigid material comprises an appliance which employs the contractional force of an expanded rubber hose and an expanded product container for the discharge of a medium stored therein. A hollow body of elastic material located in the axis of a product container is provided with a valve at one end through which it is inflated. The shape of the inner walls of the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

U.S. Pat. No. 4,257,460 to Paranay et al. describes a water gun. The novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body and a trigger mechanism may be employed for selectively releasing the pressurized water within the storage compartment.

U.S. Pat. No. 4,212,460 to Kraft describes a hollow water-filled game toy. The hollow body is provided having two complementary parts releasably joined about interfitting rim portions. When the parts are joined, the hollow body may be compressed to partially deform a portion of the rim structure into an opening thereby allowing the filling of water into the body interior. After deformation the parts resume their original shape. An effective hermetic seal to retain the water within the interior is formed by squeezing the body and purging air through the vents in the rim portions. The water-filled body may then be thrown against a stationary object whereby the force of impact will release the seal and allow the water to become suddenly released causing a splashing action. The complementary hollow parts may be subsequently rejoined and refilled with water to repeat the throwing and splashing action.

U.S. Pat. No. 4,135,559 to Barnby describes a water squirt toy and fill valve combination. The water squirt toy apparatus includes a combination of a water squirt toy and a special filling valve which function together cooperatively. The water squirt toy includes a resiliently expansible tubular member serving as a water reservoir and encased within a rigid tubular support member, and a manually operated, lever-type normally closed valve mechanism operatively associated with the expansible member for permitting or preventing fluid discharge therefrom by compressing or pinching the same. The frontward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals into the water supply whereby the discharged streams will coalesce and exhibit reduced separation so as to be discharged over significantly greater distances; and amusement apparatus which is particularly adaptable for use with the water squirt toy is also disclosed. A weakened annular portion of the tubular member is utilized to insure that the expansion begins frontward and progresses rearwardly.

U.S. Pat. No. 3,486,539 to Candido Jacuzzi describes a liquid dispensing and metering assembly. The liquid dispensing and metering assembly in which an expansible receptacle of a material adapted to maintain constant pressure characteristics over a substantial change in volume of liquid content of such receptacle, discharges through a slow rate metering-element to provide a uniform discharge flow at a low constant pressure.

SUMMARY OF THE INVENTION

The present invention is a water bomb mounted on a toy gun with a main housing which includes a frontward portion and a rearward portion rotatably connected to one another and a passageway through both the frontward and rearward portions for receiving a shut off valve. The shut off valve is located within the housing and connected to both the frontward and the rearward portions and adapted so that when the frontward and rearward portions are rotated relative to one another, the shut off valve is moved from an open position to a closed position. There is a locking mechanism connected to one of the frontward and rearward portions, and releasably connected to the other portion such that rotation of the frontward portion relative to the rearward portion will move the shut off valve to a closed position and the locking mechanism may then be used to releasably lock the frontward and rearward portions relative to one another to hold the shut off valve in its closed position until subsequently released. There is also an expandable bladder which is filled with liquid and rapidly expends liquid when the device is activated and the valve is opened.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention device is a water bomb—mounted water gun. The water bomb device may be characterized as a water grenade, a water bomb, water rocket or otherwise, but its essential feature is that it has a fillable expandable bladder which may be shut off until a release is moved to an open position (e.g. by trigger release) so as to cause a bursting of the water therefrom to simulate a water "explosion" from the water gun. The water bomb device essentially also includes a main housing which has a rearward portion and a frontward portion, wherein the frontward portion is rotatable so as to move a valve from an open position to a closed position for subsequent release thereof.

The toy gun to which the water bomb device is mounted may be a conventional pump trigger water gun, a pinch trigger bladder type water gun, a pressurized pinch trigger pump water gun such as that described in U.S. Pat. No. 5,074,437 D'Andrade et al. issued Dec. 24, 1991, a toy dart gun, a toy cap gun, and many other toy guns. By the attachment of the water bomb device to a toy gun the present invention provides new functionality of the toy gun by being able to simulate a water "explosion".

Figure 1:
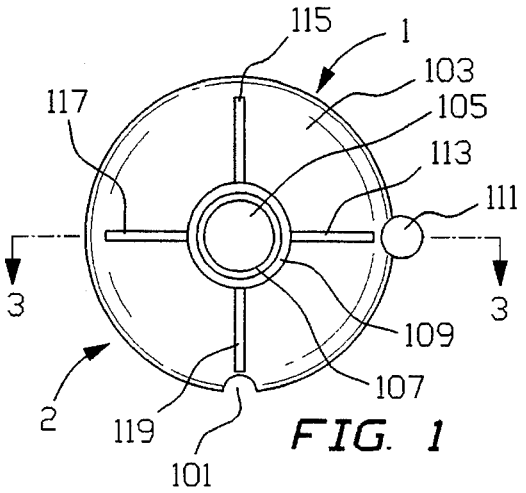
FIG. 1 shows a front view of water bomb 1.

Referring now to FIG. 1 there is shown the front view of the water bomb 1 with frontward end surface 103 of frontward portion 2 with fins 113, 115, 117 and 119 attached. The discharge outlet 105 is through flexible tube 107. The locking cap 111 is shown with the corresponding locking stop 101. The frontward end of the flexible tube 107 is fixably attached to the frontward tube 109 (e.g. by being heat sealed, glued, clamped or otherwise).

Figure 1A:
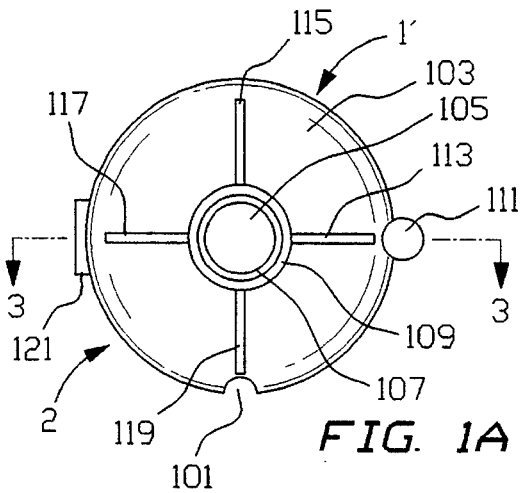
FIG. 1A shows a front view of water bomb 1' an alternative embodiment of water bomb 1.

Referring to FIG. 1A there is shown the front view of a water bomb 1' which is an alternative embodiment of the water bomb 1 with a separate fill inlet 121. All parts of water bomb 1' which are similar to water bomb 1 are numbered with the same part number.

Figure 2:
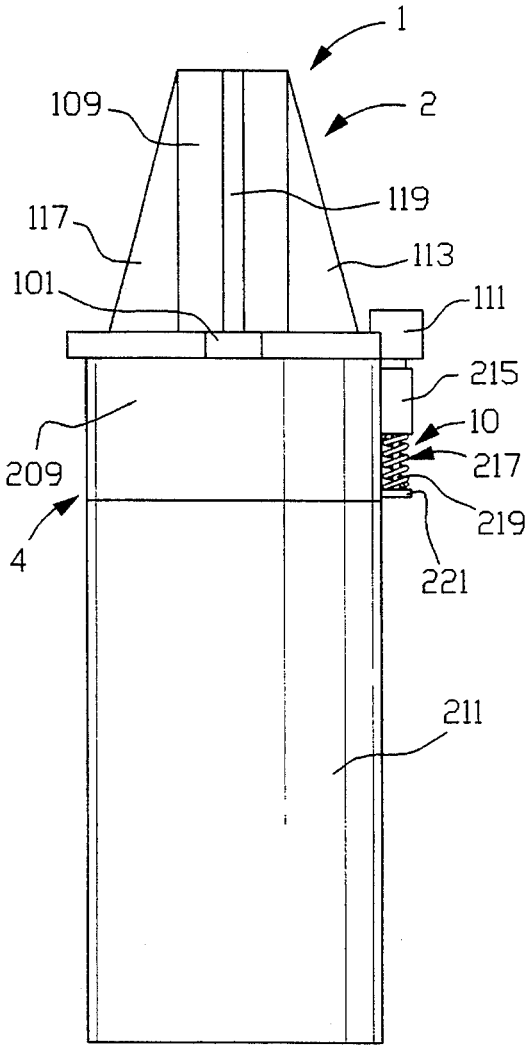
FIG. 2 shows a side view of water bomb 1.

Referring now to FIG. 2 there is shown a side view of the water bomb 1 with a frontward portion 2 and a rearward portion 4. There is illustrated a locking means 10 which includes a locking cap 111 which is attached to locking pin 219 which is attached to locking end 221 and the locking cap 111 is biased against the frontward end surface 103 of the frontward portion 2 by locking spring 217. The locking pin 219 slides a limited distance through the locking retainer 215 when the locking cap 111 is aligned with the locking stop 101. The outer shell 211 is attached to the rearward main body 209 so as to limit the expansion of the expandable bladder 6, which is shown on FIG. 3.

Figure 2A:
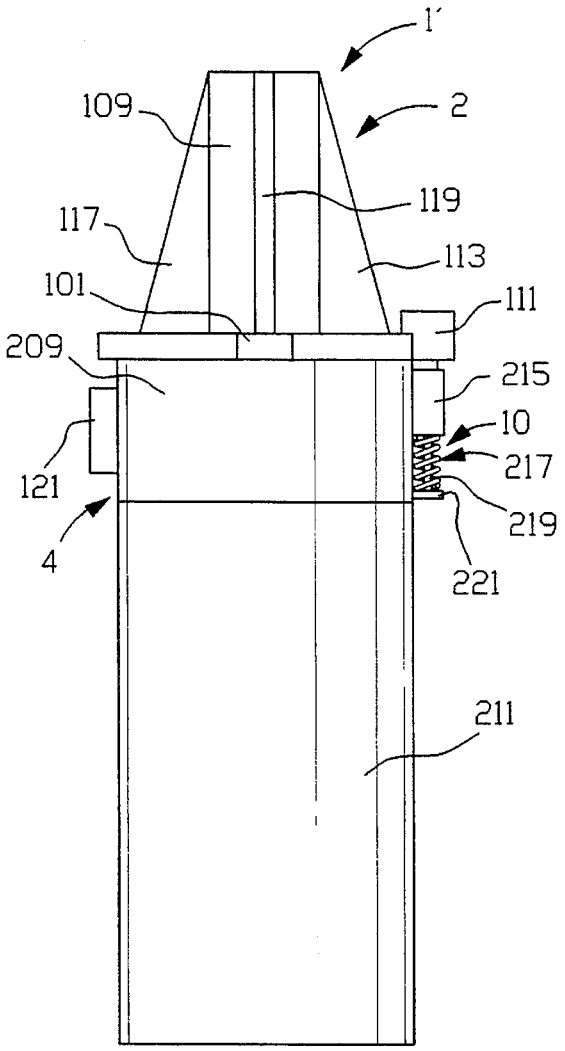
FIG. 2A shows a side view of water bomb 1'.

Referring to FIG. 2A there is shown a side view of the water bomb 1' which is an alternative embodiment of the water bomb 1 with a separate fill inlet 121. All parts of water bomb 1' which are similar to water bomb 1 are numbered with the same part number.

Figure 3A:
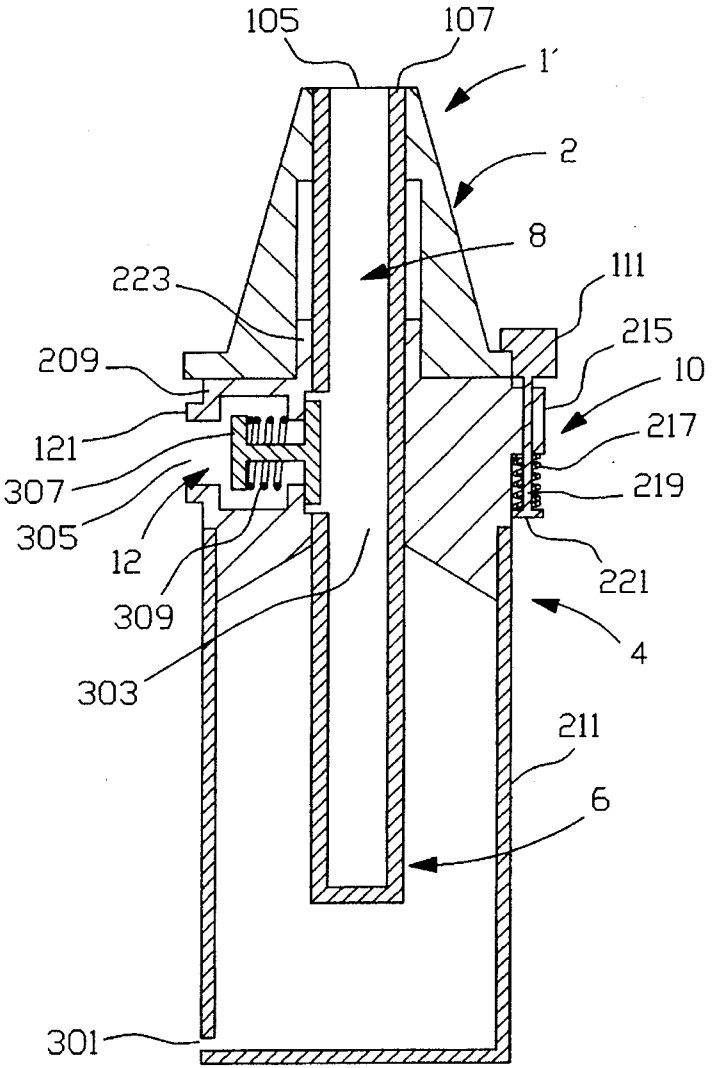
FIG. 3A shows a cross sectional view of water bomb 1' with shut off valve open and expandable bladder unfilled.
Figure 3:
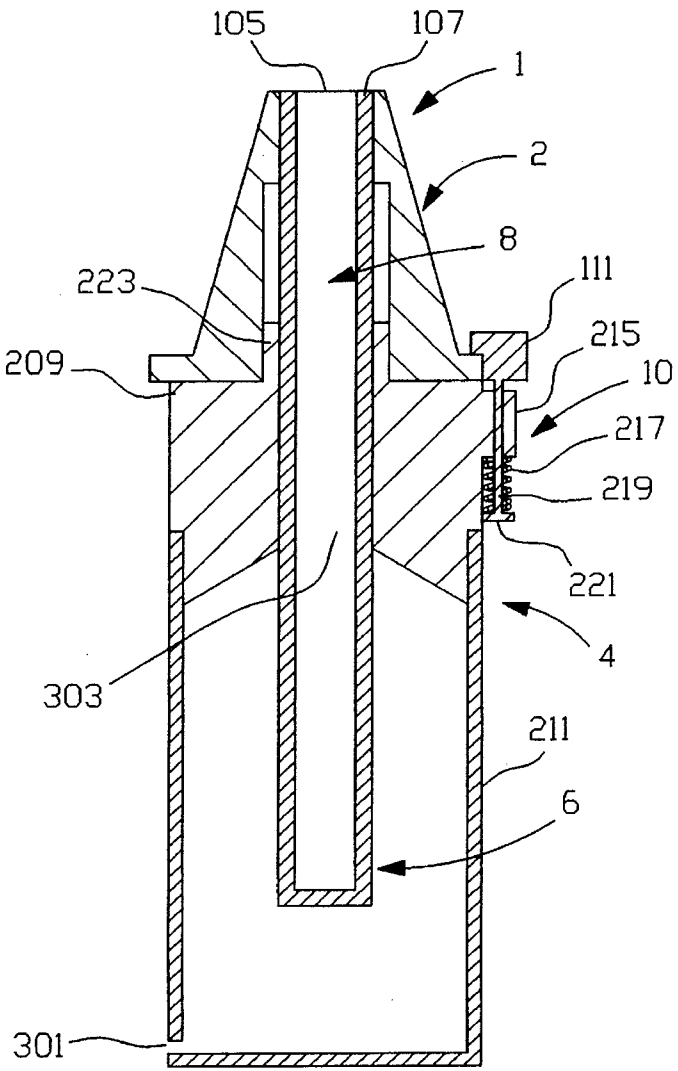
FIG. 3 shows a cross sectional view of water bomb 1 with shut off valve open and expandable bladder unfilled.

FIG. 3 illustrates a cross sectional view through cut 3 of the water bomb 1 shown in FIG. 1 with the shut off valve 8 in the open position and the expandable bladder 6 in the unfilled mode. The outer shell 211 contains a fill vent 301 to allow air to escape when the expandable bladder 6 expands. The expandable bladder 6 contains a tapered wall 303 which is utilized to insure that the expansion begins frontward and progresses rearwardly. The flexible tubing 107 is fixably attached to the rearward portion 4. Thus the frontward portion 2 and the rearward portion 4 are rotatably connected to one another and the flexible tube 107 is free to be twisted from the opened position to the closed position at shut off valve 8. The rearward portion neck 223 keeps the frontward portion 2 and the rearward portion 4 in axial alignment.

FIG. 3A illustrates a cross sectional view through cut 3A of the water bomb 1' shown in FIG. 1A with the shut off valve 8 in the open position and the expandable bladder 6 in the unfilled mode.

Figure 4A:
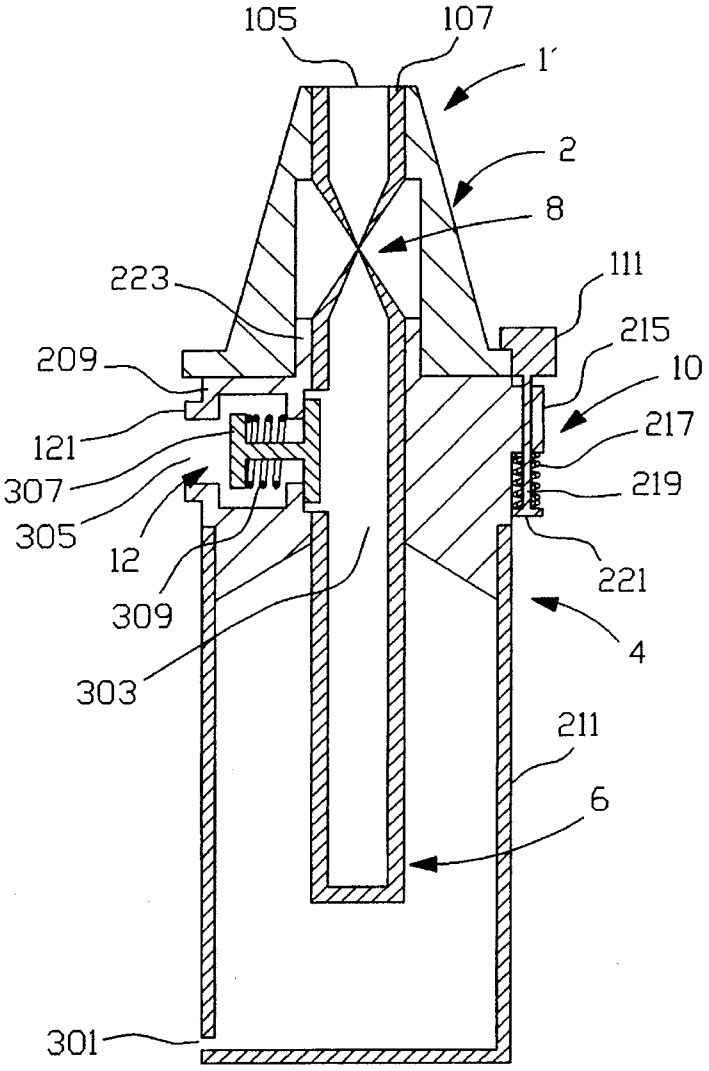
FIG. 4A shows a cross sectional view of water bomb 1' with shut off valve closed and expandable bladder unfilled.
Figure 4:
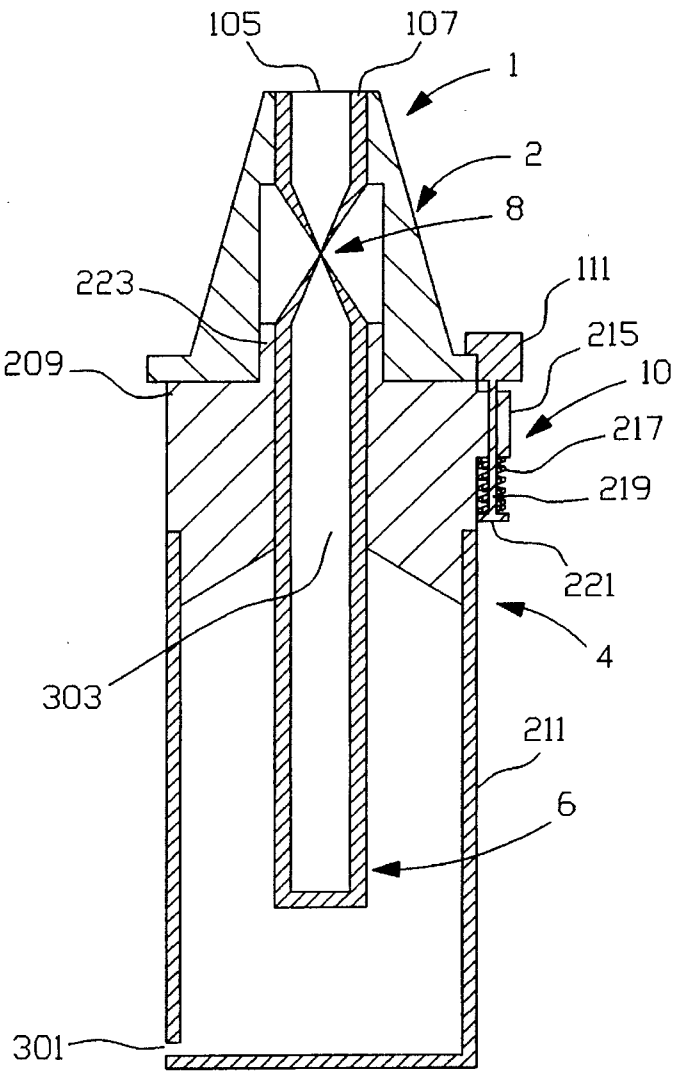
FIG. 4 shows a cross sectional view of water bomb 1 with shut off valve closed and expandable bladder unfilled.

FIG. 4 illustrates a cross sectional view through cut 3 of the water bomb 1 shown in FIG. 1 with the shut off valve 8 in the closed position and the expandable bladder 6 in the unfilled mode. When the frontward portion 2 and the rearward portion 4 are rotated relative to one another, then shut off valve 8 will be twisted from its open position to its closed position. The expandable bladder 6 may be filled by attaching a means of supplying pressurized water to the discharge outlet 105 when the shut off valve 8 is in the open position. When the expandable bladder 6 is filled the shut-off valve 8 is rotated to the closed position. When the shut off valve 8 is in the open position a passageway exists from the discharge outlet 105, through the flexible tube 107, through the frontward portion 2, through the rearward portion 4, to the expandable bladder 6.

FIG. 4A illustrates a cross sectional view through cut 3A of the water bomb 1' shown in FIG. 1A with the shut off valve 8 in the closed position and the expandable bladder 6 in the unfilled mode. All parts of water bomb 1' which are similar to water bomb 1 are numbered with the same part number. The fill inlet 121 contains a fill inlet opening 305 which internally connects to the inlet of a fluid one way valve 12 which includes a fluid one way valve plunger 307 and a fluid one way valve spring 309. The outlet of the fluid one way valve 12 is internally connected to the passageway in the rearward portion 4. Utilizing a narrow slot in the flexible tube 107 where the outlet of the fluid one way valve 12 internally connects to the passageway in the rearward portion 4, provides a connection with reduced turbulence of the water upon discharge and increases the range of the water bomb 1. Decreasing the diameter of the fluid passageway will increase the velocity of the fluid pressure, thus causing the fluid to be projected an increased distance. The expandable bladder 6 may be filled by attaching a means of supplying pressurized water to the fill inlet opening 305 when the shut off valve 8 is in the closed position.

Figure 5A:
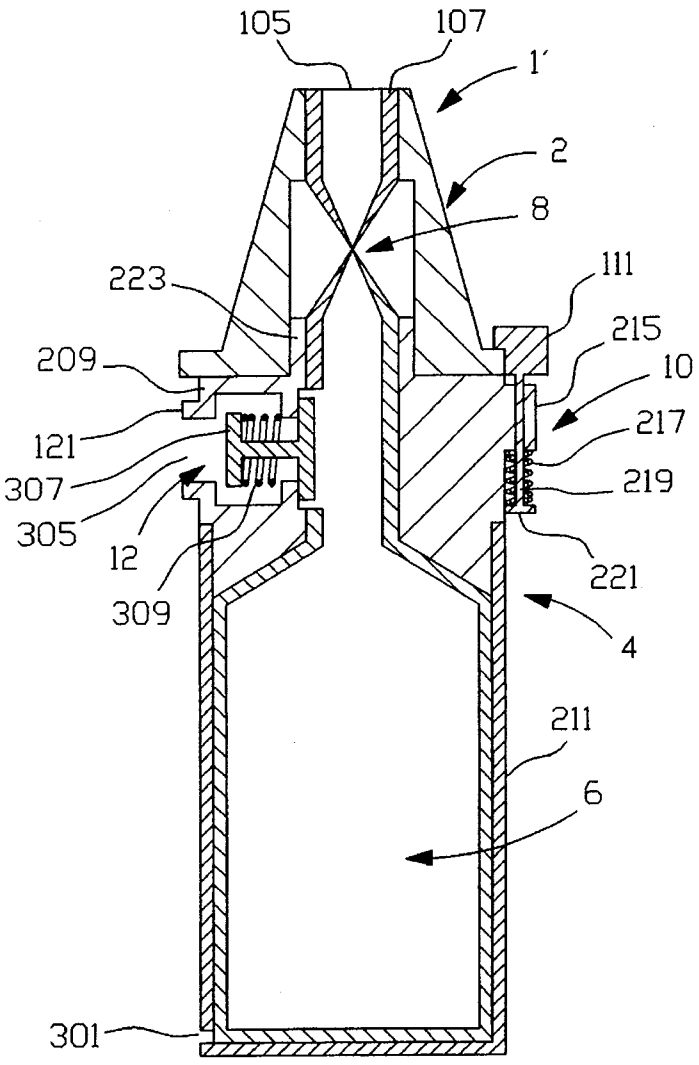
FIG. 5A shows a cross sectional view of water bomb 1' with shut off valve closed and expandable bladder filled.
Figure 5:
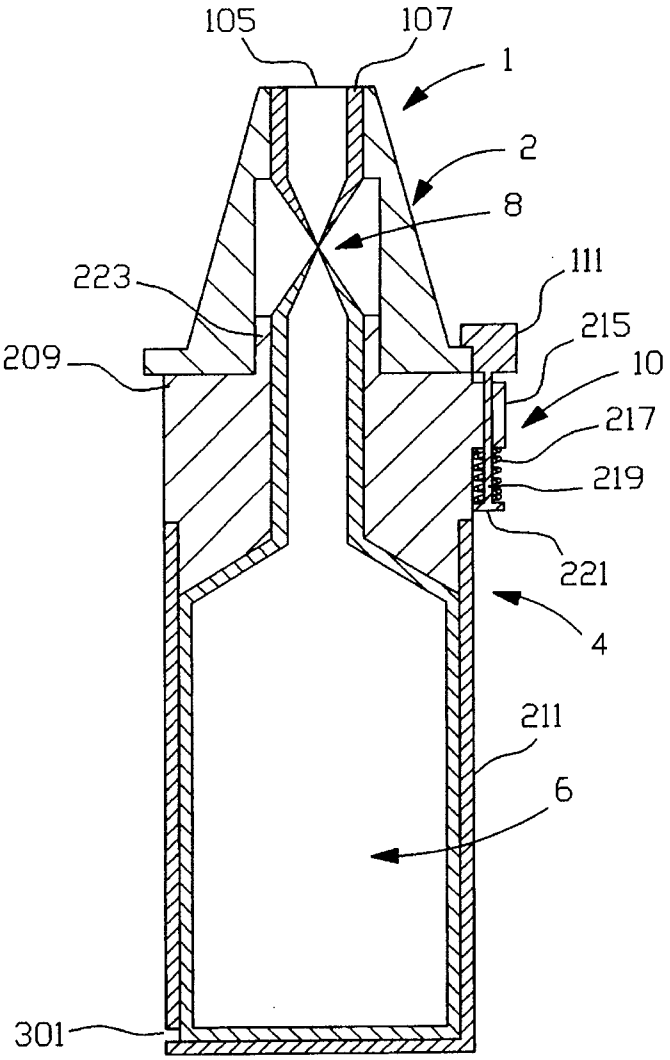
FIG. 5 shows a cross sectional view of water bomb 1 with shut off valve closed and expandable bladder filled.

FIG. 5 illustrates a cross sectional view of the water bomb 1 through cut 3 shown in FIG. 1 with the expandable bladder 6 filled, the shut off valve 8 in the closed position and the locking means 10 in the locked position.

FIG. 5A illustrates a cross sectional view through cut 3A of the water bomb 1' shown in FIG. 1A with the expandable bladder 6 filled, the shut off valve 8 in the closed position and the locking means 10 in the locked position. All parts of water bomb 1' which are similar to water bomb 1 are numbered with the same part number.

With respect to water bomb 1 shown in FIGS. 1, 2, 3, 4 and 5 and water bomb 1' shown in FIGS. 1A, 2A, 3A, 4A and 5A, the rotation of the frontward portion 2 relative to the rearward portion 4 will align the locking cap 111 with the locking stop 101. This will cause the locking means 10 to move to the locked position.

Figure 6A:
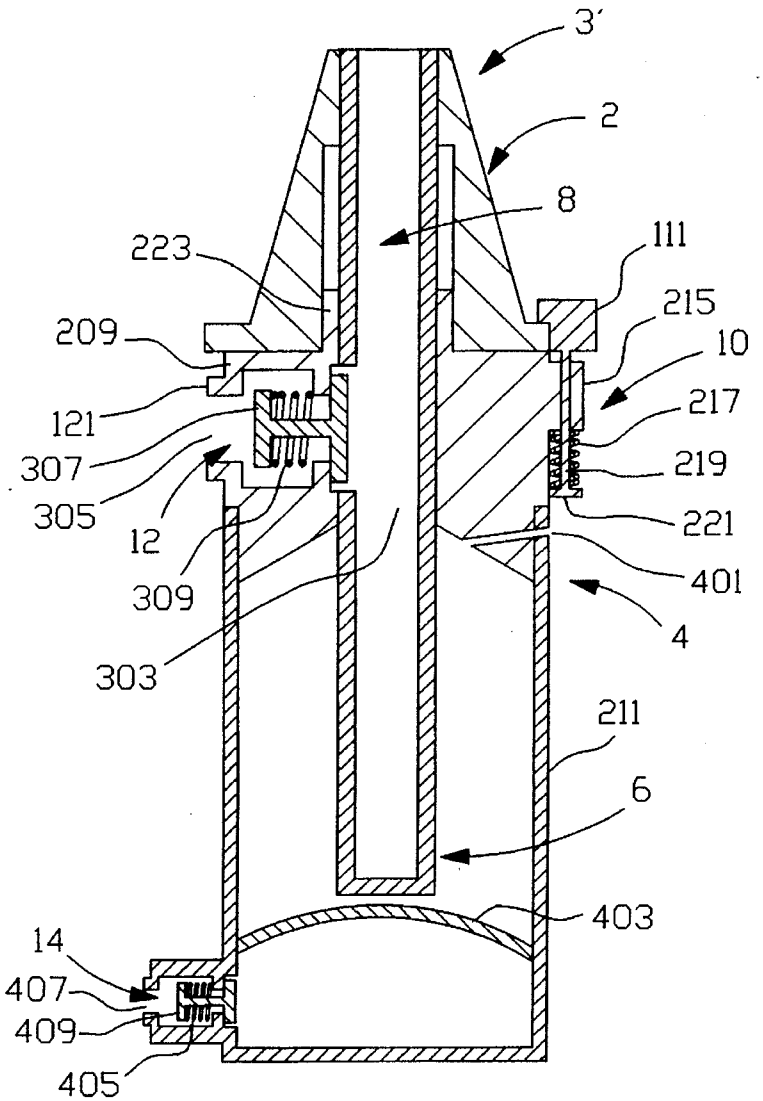
FIG. 6A shows a cross sectional view of water bomb 3' an alternative embodiment of water bomb 1' with shut off valve open and expandable bladder unfilled.
Figure 6:
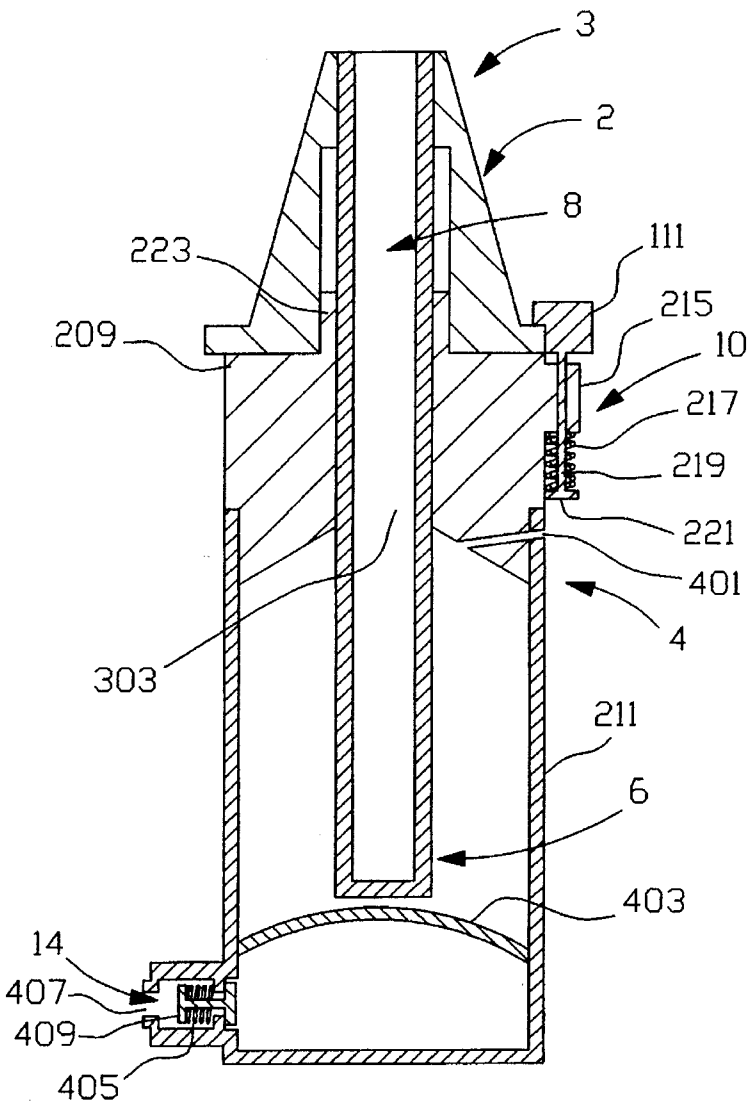
FIG. 6 shows a cross sectional view of water bomb 3 an alternative embodiment of water bomb 1 with shut off valve open and expandable bladder unfilled.

FIG. 6 illustrates a cross sectional view of water bomb 3 which is an alternative embodiment of water bomb 1 which utilizes air pressure to expel the contents of the expandable bladder 6 with greater force. FIG. 6 shows the shut off valve 8 in the open position and the expandable bladder 6 in the unfilled mode. All parts of water bomb 3 which are similar to water bomb 1 are numbered with the same part number. The expandable bladder 6 is first filled so as to completely fill up the volume of the outer shell 211 up to the perforated bladder stop 403. This will result in the blocking (closing) of pressure purge vent 401. A means for supplying pressurized air is connected to the pressurized air inlet 407. When a sufficient air pressure has been supplied the water bomb 1 is ready for use. The pressurized air inlet 407 contains an air one way valve 14 which has an air one way valve plunger 409 and an air one way valve spring 405 to prevent the escape of the air pressure. The perforated bladder stop 403 limits the expansion of the expandable bladder 6 but permits pressurized air which is filled into the remaining space inside of the outer shell 211 to be in communication with the expandable bladder 6. When the water bomb release trigger 601 is moved it pushes locking end 221 frontward to allow the frontward portion 2 to rotate so as to open the shut off valve 8 and the contents of the expanded bladder 6 would be forced through flexible tube 107 and through the discharge outlet 105 in an explosive fashion. When the expandable bladder 6 has been discharged the pressure purge vent 401 is open permitting any residual air pressure to be vented from the inside of the outer shell 211.

FIG. 6A illustrates a cross sectional view of water bomb 3' which is an alternative embodiment of water bomb 1' which utilizes air pressure to expel the contents of the expandable bladder 6 with greater force. FIG. 6A shows the shut off valve 8 in the open position and the expandable bladder 6 in the unfilled mode. All parts of water bomb 3' which are similar to water bomb 1' are numbered with the same part number.

With respect to water bomb 3 and water bomb 3', the rotation of the frontward portion 2 relative to the rearward portion 4 will align the locking cap 111 with the locking stop 101. This will cause the locking means 10 to move to the locked position.

Figure 7:
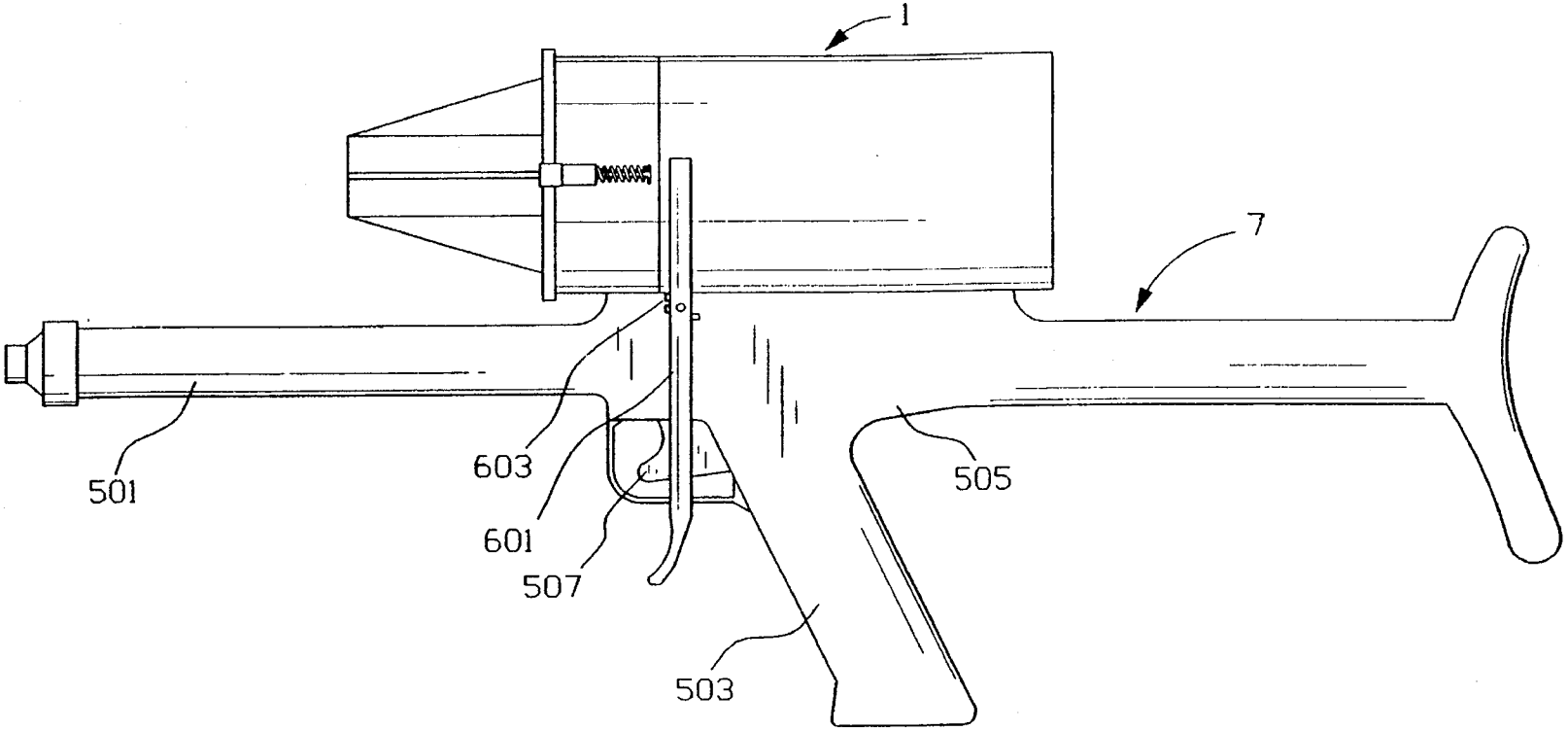
FIG. 7 shows water bomb 1 attached to a toy gun.

FIG. 7 illustrates the water bomb 1 attached to a toy gun 7. The toy gun 7 contains a gun housing 505 which has a gun barrel 501 attached at one end of the gun housing 505, a gun handle 503 attached to the bottom of the gun housing 505, and a gun trigger 507 for triggering a means for dispensing a liquid from the toy gun 7 through the gun barrel 501. A water bomb release trigger 601 is pivotally attached to the toy gun 7 and biased against release by the water bomb release trigger spring 603. When the water bomb release trigger 601 is moved it pushes locking end 221 frontward to allow the frontward portion 2 to rotate so as to open the shut off valve 8 and the contents of the expanded bladder 6 would be forced through the flexible tube 107 and through the discharge outlet 105 in an "explosive" fashion.

Figure 8:
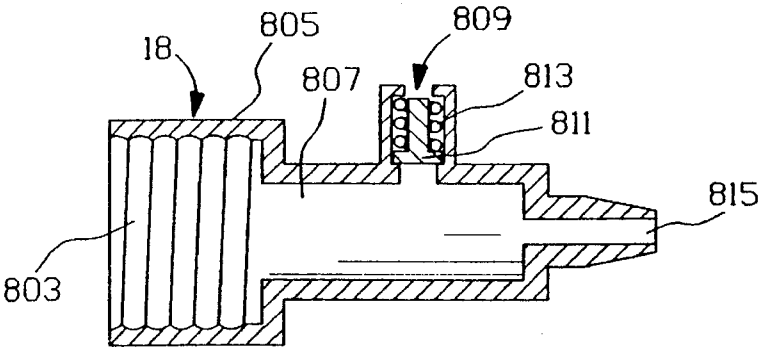
FIG. 8 shows a cross sectional view of a filling mechanism useful in the present invention water bomb—mounted water gun.

Referring to both FIGS. 1, 1A, 6, 6A and 8, there is shown in FIG. 8 a filling mechanism 18 having a top and left 805 with threads 803 adapted to be attached to a standard garden hose or an outdoor threaded faucet. It has a main chamber 807 with a side water pressure release valve 809 which includes a spring 813 and a plunger valve 811. There is an outlet 815 which is adapted to fit into the discharge outlet 105 of water bomb 1, the discharge outlet 105 of water bomb 3, the fill inlet opening 305 of water bomb 1', and the fill inlet opening 305 of water bomb 3'. This filling mechanism 18 is inserted as indicated, after it has been attached to a garden hose or faucet or otherwise, water is released by opening a valve or faucet and the water expands the expandable bladder 6, so as to completely fill up the volume of the outer shell 211 as shown in FIGS. 5 and 5A.

Water bomb 1, water bomb 1', water bomb 3 and water bomb 3' can be made in a variety of sizes to suit the toy gun to which they are attached and the type of water "explosion" they are to simulate. By increasing the volume of the expandable bladder 6 without increasing the cross sectional area of the discharge outlet 105 the duration of the discharge of the liquid will increase. By increasing the cross sectional area of the discharge outlet 105 without increasing the volume of the expandable bladder 6 the duration of the discharge of the liquid will decrease and the rate of discharge of the liquid will increase. By increasing the volume of the expandable bladder 6 and increasing the cross sectional area of the discharge outlet 105 the water bomb can simulate a macro-water "explosion".

Where water bomb 1, water bomb 1', water bomb 3 or water bomb 3' are removably attached to the toy gun 7 it is possible to fill the water bombs when they are unattached and utilize the filled water bombs as loadable water bomb cartridges.

Obviously, numerous modifications and variations of the present invention are possible in light of the above teachings. For example, while the present invention device is efficiently developed and designed so as to utilize the shut off valve 8 both as a fill port and as the exit port, an alternative embodiment shows a separate fill inlet 121 and fluid one way valve 12 remotely located from the shut off valve 8 but connected to the expandable bladder 6. Also, for example, it is possible to utilize other types of valves in place of the fluid one way valve 12 or the air one way valve 14. Further, any of numerous locking means can be utilized to releasably lock the frontward portion 2 to the rearward portion 4 which can be released by a number of alternatives to the water bomb release trigger 601. The locking means 10 may be also be released by a timing mechanism. The timing mechanism would be a set of gears and a spring which would operate like a clock for a chess game, an egg timer, or any other internal mechanism. These spring loaded winding, timing mechanisms are well within the skill of the artisan although not in the context of the present invention.

It is therefore understood that within the scope of the appended claims, the invention may be practiced otherwise than as specifically described herein.

What is claimed is:

1. A water bomb—mounted gun, comprising:

(a) a water bomb device, having:

(1) a main housing having a frontward portion and a rearward portion rotatably connected to one another and having a passageway through both of the frontward portion and the rearward portion for receiving a shut off valve;

(2) a shut off valve located within the main housing and connected to the frontward portion and the rearward portion of the main housing and adapted so that when the frontward portion and the rearward portion of the main housing are rotated relative to one another, the shut off valve is moved from an open position to a closed position;

(3) a locking means connected to the rearward portion of the main housing and releasably connected to the frontward portion of the main housing such that the frontward portion may be rotated relative to the rearward portion to move the shut off valve to a closed position and the locking means may then be used to releaseably lock the frontward portion and the rearward portion relative to one another to hold the shut off valve it its closed position until subsequently released; and (4) an expandable bladder connected to the rearward portion of the main housing so that fluid may pass through the shut off valve in the open position and expand the expandable bladder to a predetermined volume of fluid, the frontward portion of the main housing may be rotated relative to the rearward portion so as to move the shut off valve to its closed position, and the locking means may then lock the device in a filled bladder, closed valve position, whereby the locking means may be subsequently released such that the expandable bladder will rapidly contract and expel fluid through the shut off valve having a predetermined cross sectional discharge area to simulate a water explosion;

and, (b) a toy gun, having:

(1) a gun housing;

(2) a gun barrel of the housing extending outwardly;

(3) an extended gun handle attached to the gun housing; and, (4) a trigger means for releasing the locking means.

2. The device as recited in claim 1 wherein the water bomb device further includes an outer shell member attached to the main housing and surrounding the expandable bladder and having a predetermined volume so as to limit the maximum expansion of the bladder.

3. The device of claim 1 wherein the water bomb device further includes a fluid valve having an inlet and an outlet, located in the rearward portion of the main housing, the inlet of the fluid valve in internal fluid communication with a fill inlet adapted to receive a means for supplying pressurized water, the outlet of the fluid valve in internal fluid communication with the expandable bladder.

4. The device as recited in claim 2 wherein the outer shell member is adapted to receive pressurization by a pressurizing means.

5. The device as recited in claim 1 wherein the rearward portion of the main housing of the water bomb device is removably attached to the toy gun.

6. The device of claim 1 wherein the device further includes a removable fill mechanism having an inlet which is attachable to a threaded faucet, a pressure relief valve set to open at a predetermined pressure and an insertable outlet adapted to fit into the passageway of the main housing.

7. The device of claim 1 wherein the expandable bladder includes a tapered wall wherein expansion begins frontward and progresses rearwardly.

8. A water bomb device, comprising:

(a) a water bomb device, having:

(1) a main housing having a frontward portion and a rearward portion rotatably connected to one another and having a passageway through both the frontward portion and rearward portion, the passageway having a shut off valve and an expandable bladder, the shut off valve adapted so that when the frontward portion and the rearward portion of the main housing are rotated relative to one another, the shut off valve is moved from an open position to a closed position, the expandable bladder adapted to expand and hold a predetermined volume of fluid flowing through the shut off valve in the open position; and (2) a locking means connected to the rearward portion of the main housing and releasably connected to the frontward portion of the main housing such that the frontward portion may be rotated relative to the rearward portion to move the shut off valve to its closed position after the expandable bladder is filled, and the locking means may then lock the device in a filled bladder, closed valve position, whereby the locking means may be subsequently released such that the expandable bladder will rapidly contract and expel fluid through the shut off valve to simulate a water explosion;

and, (b) a toy gun, having:

(1) a gun housing;

(2) a gun barrel of the housing extending outwardly;

(3) an extended gun handle attached to the gun housing; and (4) a trigger means for releasing the locking means.

9. The device of claim 8 wherein the water bomb device further includes an outer shell member attached to the main housing and surrounding the expandable bladder and having a predetermined volume so as to limit the maximum expansion of the bladder.

10. The device of claim 8 wherein the water bomb device further includes a fluid valve having an inlet and an outlet, located in the rearward portion of the main housing, the inlet of the fluid valve in internal fluid communication with a fill inlet adapted to receive a means for supplying pressurized water, the outlet of the fluid valve in internal fluid communication with the expandable bladder.

11. The device of claim 10 wherein the outer shell member is adapted to receive pressurization by a pressurizing means.

12. The device of claim 11 wherein the rearward portion of the main housing of the water bomb device is removably attached to the toy gun.

13. The device of claim 8 wherein the device further includes a removable fill mechanism having an inlet which is attachable to a threaded faucet, a pressure relief valve set to open at a predetermined pressure and an insertable outlet adapted to fit into the passageway of the main housing.

14. The device of claim 8 wherein the expandable bladder includes a tapered wall wherein expansion begins frontward and progresses rearwardly.

15. A water gun with a mounted water bomb comprising:

(a) a water bomb device, having:

a main housing having a frontward portion and a rearward portion rotatably connected to one another and having a passageway through both of the frontward portion and rearward portion, said passageway located in the main housing and having a shut off valve and an expandable bladder, the shut off valve adapted so that when the frontward portion and the rearward portion of the main housing are rotated relative to one another, the shut off valve is moved from an open position to a closed position, the expandable bladder adapted to expand and hold a predetermined volume of fluid flowing through the shut off valve in the open position and whereby the closed valve may be subsequently released such that the expandable bladder will rapidly contract and expel fluid through the shut off valve to simulate a water explosion;

and, (b) a toy gun, having:

(1) a gun housing;

(2) a gun barrel of the housing extending outwardly; and (3) an extended gun handle attached to the gun housing.

16. The device of claim 15 wherein the water bomb device further includes an outer shell member attached to the main housing and surrounding the expandable bladder and having a predetermined volume so as to limit the maximum expansion of the bladder.

17. The device of claim 15 wherein the water bomb device further includes a fluid valve having an inlet and an outlet, located in the rearward portion of the main housing, the inlet of the fluid valve in internal fluid communication with a fill inlet adapted to receive a means for supplying pressurized water, the outlet of the fluid valve in internal fluid communication with the expandable bladder.

18. The device of claim 17 wherein the outer shell member is adapted to receive pressurization by a pressurizing means.

19. The device of claim 18 wherein the rearward portion of the main housing of the water bomb device is removably attached to the toy gun.

20. The device of claim 15 wherein the device further includes a removable fill mechanism having an inlet which is attachable to a threaded faucet, a pressure relief valve set to open at a predetermined pressure and an insertable outlet adapted to fit into the passageway of the main housing.

* * * * *